US006948892B2

(12) United States Patent
Hummel

(10) Patent No.: US 6,948,892 B2
(45) Date of Patent: Sep. 27, 2005

(54) LIFT MECHANISM FOR PLUNGE ROUTERS

(76) Inventor: Richard M. Hummel, 8318 Manorford Dr., Parma, OH (US) 44129

( * ) Notice: Subject to any disclaimer, the term of this patent is extended or adjusted under 35 U.S.C. 154(b) by 253 days.

(21) Appl. No.: 10/159,356

(22) Filed: May 30, 2002

(65) Prior Publication Data

US 2003/0223835 A1 Dec. 4, 2003

(51) Int. Cl.[7] ..... B23C 5/00
(52) U.S. Cl. ..... 409/182; 144/135.2; 409/229
(58) Field of Search ..... 409/182, 228, 409/229; 144/135.2

(56) References Cited

U.S. PATENT DOCUMENTS

| | | | | |
|---|---|---|---|---|
| 3,710,833 A | | 1/1973 | Hammer et al. | |
| 4,454,898 A | | 6/1984 | Pavnica | |
| 4,456,042 A | | 6/1984 | Clark et al. | |
| 4,537,234 A | | 8/1985 | Onsrud | |
| 5,139,061 A | | 8/1992 | Neilson | |
| 5,590,989 A | * | 1/1997 | Mulvihill | 409/182 |
| 5,725,036 A | | 3/1998 | Walter | |
| 5,772,368 A | | 6/1998 | Posh | |
| 6,318,936 B1 | * | 11/2001 | McFarlin et al. | 409/131 |
| 6,374,878 B1 | | 4/2002 | Mastley et al. | |
| 6,505,659 B1 | * | 1/2003 | Hummel | 144/135.2 |
| 6,550,154 B1 | * | 4/2003 | Smith | 33/638 |
| 6,725,892 B2 | * | 4/2004 | McDonald et al. | 144/136.95 |
| 2002/0020466 A1 | * | 2/2002 | Mc Farlin et al. | 144/135.2 |
| 2002/0189713 A1 | * | 12/2002 | Fontaine | 144/135.2 |

FOREIGN PATENT DOCUMENTS

CA 2314653 1/2001

* cited by examiner

*Primary Examiner*—Daniel W. Howell
(74) *Attorney, Agent, or Firm*—Fay, Sharpe, Fagan, Minnich & McKee, LLP

(57) ABSTRACT

A lift mechanism for a plunge router mounted on the underside of a router table comprises an adjusting screw extending vertically beneath the table and being rotatable relative to the table from the top side thereof, and a lift arm threadedly engaged with the screw and having an end spaced from the screw and interconnected with the router, whereby rotation of the screw displaces the router relative to the table.

26 Claims, 3 Drawing Sheets

LIFT MECHANISM FOR PLUNGE ROUTERS

BACKGROUND OF THE INVENTION

This invention relates to the art of routers and, more particularly, to an improved lift mechanism for adjusting the position of a plunge router relative to the work supporting surface beneath which the router is mounted.

It is of course well known that a plunge router comprises a router base transverse to and axially slidably interengaged with the router housing for adjusting the axial distance between the router and base and thus the position of a router bit relative to the base. The base is axially slidably interengaged with the router housing by a pair of guide rods attached to the base and extending into guide rod receiving passages in the router housing, and spring components bias the guide rods and thus the router base axially outwardly of the router housing. An adjustable stop rod mechanism provides for adjusting the axial position of the base relative to the router housing and thus the plunge depth of the router bit.

It is also well known that plunge routers are used for hand held routing and are much more popular than fixed base routers. Further, many woodworkers invert their plunge routers and install them on a router table by mounting the router on the underside thereof. When so mounted, however, it becomes very difficult and awkward to adjust the router bit height in that the latter adjustment must be made from under the table. One effort to reduce the difficulty of such adjustment contemplates the use of a ratchet mechanism fastened to the threaded stop rod of a plunge router and operated by a lever. While this arrangement may decrease the awkwardness and difficulty of adjusting the router bit height relative to the table, the mechanism is structurally complex and expensive to manufacture and still requires manipulating the adjusting components from beneath the table.

SUMMARY OF THE INVENTION

In accordance with the present invention, an improved lift mechanism is provided for adjusting the router bit height of a plunge router relative to the working surface of a router table beneath which the plunge router is mounted. More particularly in this respect, the lift mechanism is operable from the top side of the router table, thereby eliminating any awkwardness with regard to making a desired adjustment and minimizing the effort required to achieve adjustment. Still further in accordance with the invention, the upper end of the lift mechanism can be provided with indicia visible at the top side of the table, thus promoting precision and accuracy with respect to adjustments of the router bit height relative to the top side of the table. A lift mechanism according to the invention comprises a threaded lift rod rotatable relative to the router table and a lift arm threadedly interengaged with the rod and having an end radially spaced from the rod and attached to the router, whereby rotation of the lift rod results in axial displacement of the lift arm and thus the router relative to the table. Accordingly, it will be appreciated that a lift mechanism according to the invention comprises a minimum number of component parts which are structurally interrelated in a manner which makes the operation thereof and thus the desired adjustment of a plunge router relative to a router table extremely efficient and easy to achieve while, at the same time, providing for incremental adjustment and the ability to optimize accuracy with respect to a given adjustment.

It is accordingly an outstanding object of the present invention to provide an improved lift mechanism for adjusting the height of a plunge router bit relative to a router table beneath which the plunge router is mounted.

Another object is the provision of a lift mechanism of the foregoing character which is operable from the top side of the router table.

A further object is the provision of a lift mechanism of the foregoing character which is structurally simple, easy to operate and efficient in operation.

Yet another object is the provision of a lift mechanism of the foregoing character by which the height of a router bit relative to the router table can be incrementally adjusted with accuracy.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which.

DESCRIPTION OF A PREFERRED EMBODIMENT

Figure 1:
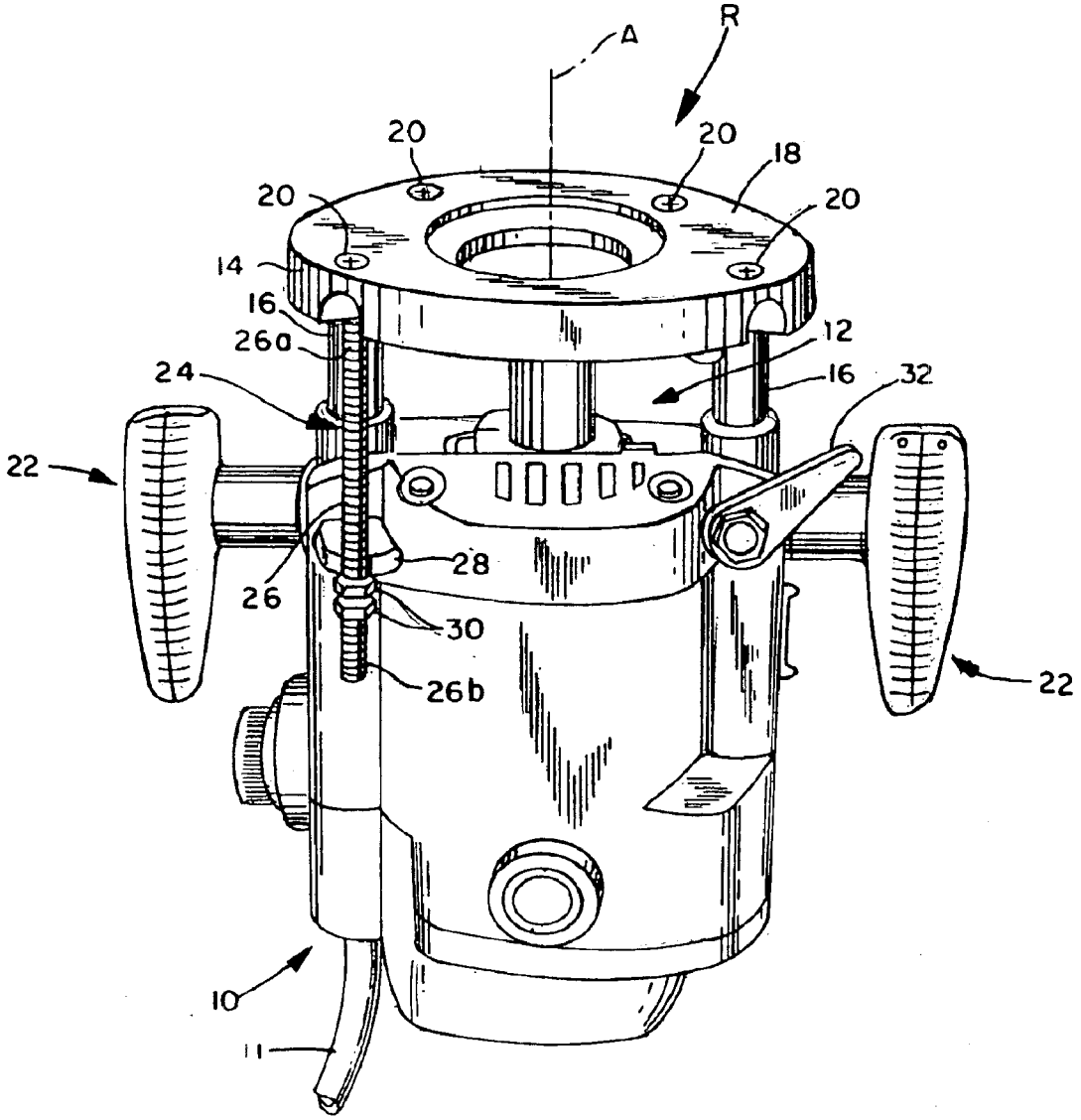
FIG. 1 is a perspective view of a plunge router of the character to be provided with a lift mechanism in accordance with the present invention.

Referring now in greater detail to the drawings, wherein the showings are for the purpose of illustrating a preferred embodiment of the invention only, and not for the purpose of limiting the invention, FIG. 1 of the drawing illustrates a Hitachi Model M12V plunge router R and is shown only to provide an example of the type of router to which the present invention is applicable. As is well known, routers of the character shown in FIG. 1 are electric motor driven and include a housing 10 enclosing the electric motor which has a power cord 11 and an output shaft provided with a router bit chuck 12 for removably mounting a desired router bit on the router for rotation about the router axis A. The router further includes a base 14 mounted on the axially outer ends of a pair of support and guide rods 16 which are axially slidably received in bores provided therefor in the housing, whereby the base is axially displaceable toward and away from housing 10. While not shown, it is well known that springs are interposed between rods 16 and the bores therefor to bias the base axially outwardly of housing 10. Base 14 generally includes a sub-base component 18 in the form of a smooth plastic disk attached to the base by a plurality of threaded fasteners 20. The sub-base component provides a smooth surface for engaging with a piece of wood to be routed.

Generally, plunge routers are hand operated and, for this purpose, housing 10 is provided with a pair of diametrically opposed handles 22. It will be appreciated that FIG. 1 illustrates the router in an inverted position with respect to the position in which it would be during a hand routing operation. As is well known in connection with the latter, the position of base 14 relative to housing 10, and thus the plunge depth of a router bit relative to work being routed, is adapted to be adjusted through the use of a stop rod mechanism 24 which, in the router illustrated, includes a threaded stop rod 26, and abutment member 28 on housing 10, and stop and lock nuts 30 on rod 26. Rod 26 has an upper end 26*a* interconnected with base 14 such as by threaded interengagement therewith and a lower end 26*b* which receives nuts 30. The particular router illustrated in FIG. 1 further includes a plunge lock lever 32 which, as is well known, is adapted to releasably hold base 14 in a given position relative to housing 10 by releasably interengaging the housing and one of the support and guide posts 16. Such locking of the base may be desired during a bit changing or plunge depth adjusting operation.

Figure 2:
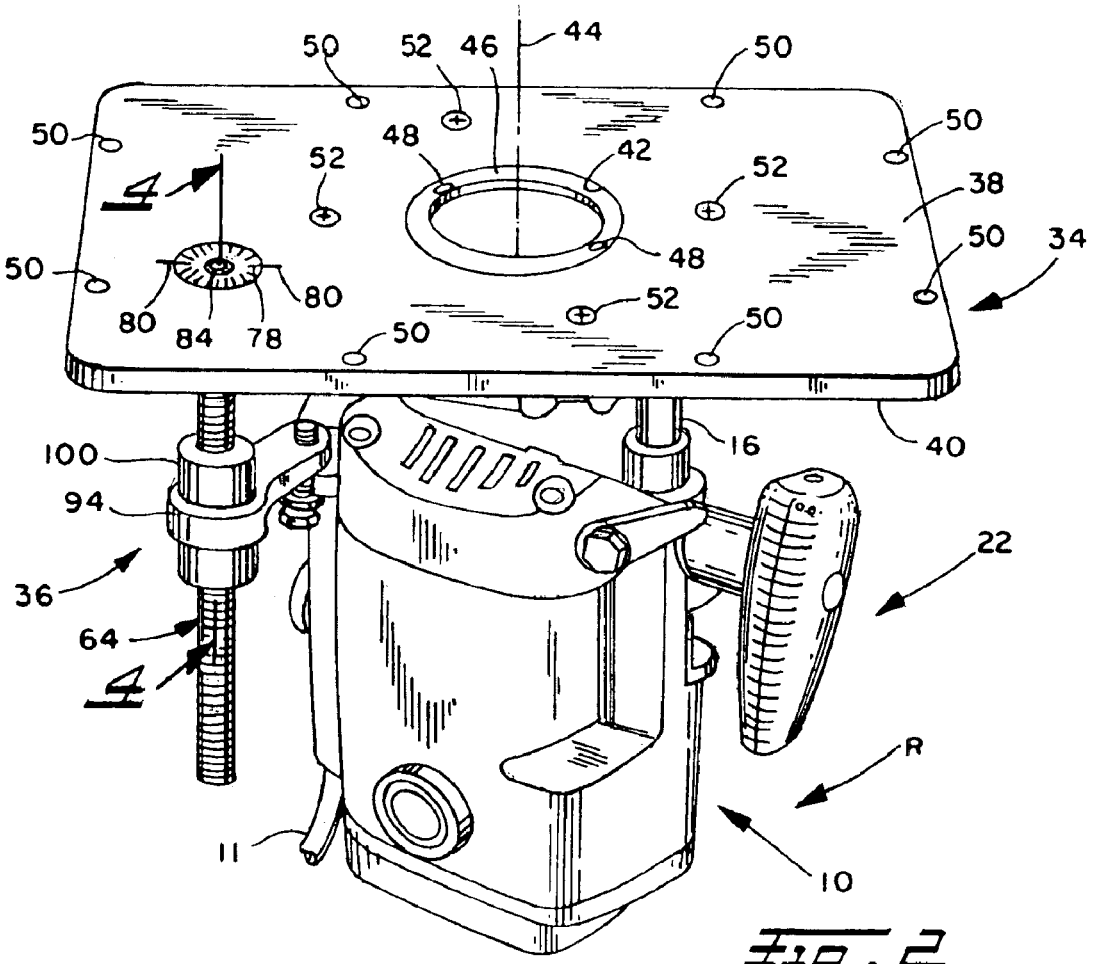
FIG. 2 is a perspective view of the router in FIG. 1 mounted on the underside of a router table plate and provided with a lift mechanism in accordance with the invention.

As shown in FIG. 2 and described in detail hereinafter, router R is mounted on the underside of a router table plate 34 in conjunction with a lift mechanism 36 according to the present invention. In the disclosed embodiment, table plate 34 is adapted to be inserted into an opening provided therefor in the top of a router table, but it will be appreciated that router R and lift mechanism 36 could be incorporated as an integral part of a router table with the router and lift mechanism suspended beneath the table top as opposed to a table plate. Preferably, table plate 34 is of cast aluminum and has top and bottom sides 38 and 40, respectively, and an opening 42 therethrough having an axis 44. Opening 42 is adapted to receive any one of a plurality of removable ring members 46 having different sized openings therethrough coaxial with axis 44 for accommodating a particular router bit. While not shown, the inner periphery of opening 42 and the outer periphery of rings 46 are provided with interengaging twist-lock components, and the ring members are provided with diametrically opposed openings 48 for accommodating a spanner wrench by which a ring is mounted and removed from the table plate. The peripheral edge of plate 12 is provided with a plurality of openings 50 therethrough for receiving threaded fasteners by which the plate is adapted to be leveled relative to the tabletop.

Figure 3:
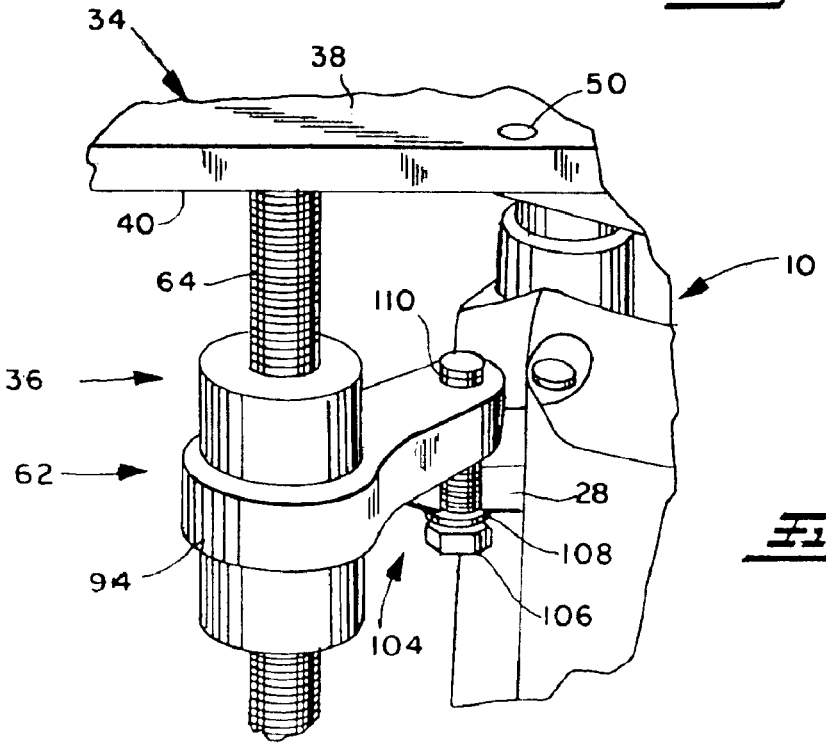
FIG. 3 is an enlarged perspective view showing the connection of the lift arm to the router housing.
Figure 4:
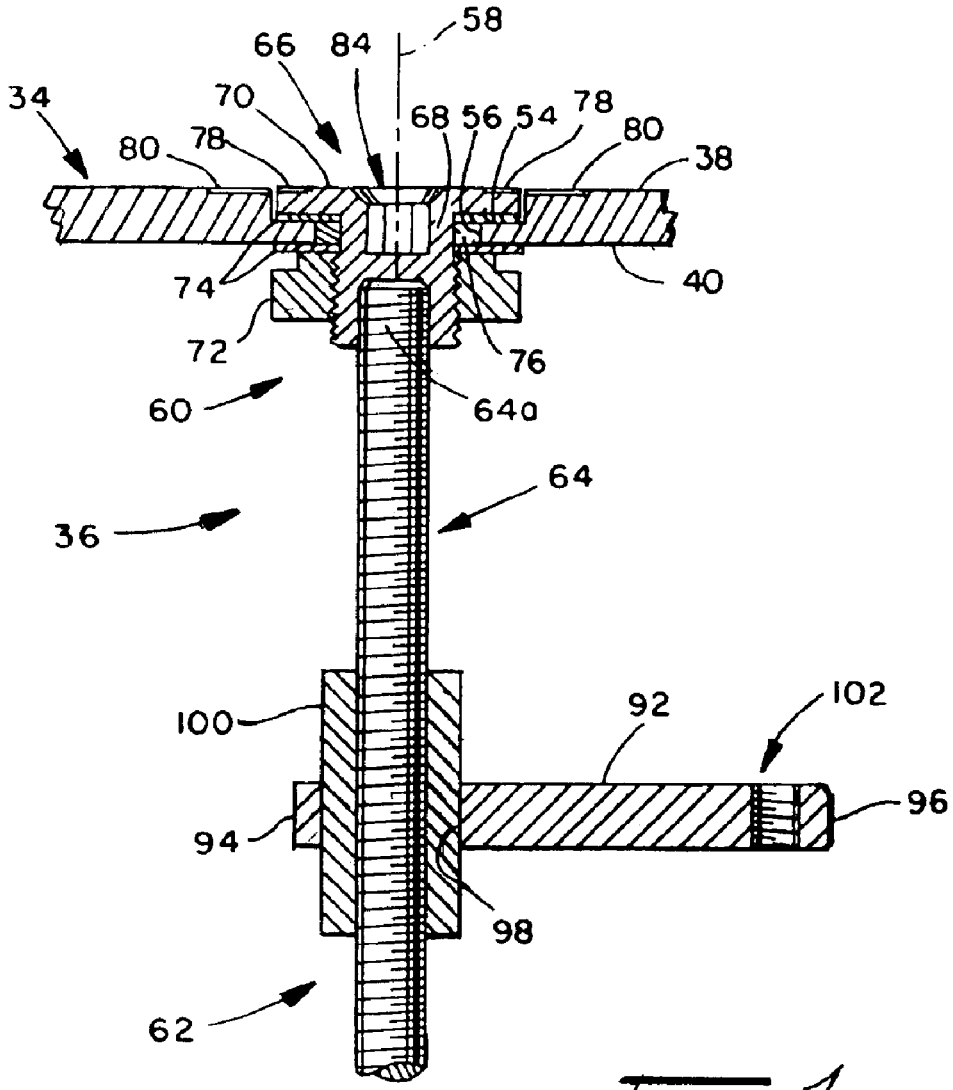
FIG. 4 is a sectional elevation view of the lift mechanism taken along line 4—4 in FIG. 2; and, FIG. 5 is a perspective view of a crank member by which the lift mechanism is operated.

With reference to FIGS. 2–4 of the drawing, lift mechanism 36 is structured and mounted on table plate 34 as follows. Plate 34 is provided with a stepped opening therethrough for the lift mechanism, not designated numerically, which includes a radial shoulder 54 and a central opening 56 having an axis 58. Lift mechanism 36 is comprised of an adjusting screw assembly 60 and a lift arm 62 threadedly interengaged with the adjusting screw assembly and attached to router R as set forth more fully hereinafter. Adjusting screw assembly 60 includes a threaded lift screw 64, preferably of stainless steel, and a cap member 66, preferably of mild steel, interengaged with the upper end thereof. The screw assembly is mounted in the table plate opening to be coaxial with and rotatable about axis 58. More particularly in this respect, cap member 66 includes a hub portion 68 extending downwardly through central opening 56 and a radially outwardly extending circumferential flange 70 overlying shoulder 54 of the stepped opening through plate 34. The lower end of hub 68 is internally threaded to receive upper end 64*a* of screw 64 and the upper end of the screw and the hub are interconnected against relative rotation such as by a chemical bond therebetween. The lower end of hub 68 is externally threaded to receive a brass mounting nut 72 by which adjusting screw, assembly 60 is axially and rotatably secured to the table plate. Preferably, bronze bushings 74 are interposed between flange 70 and shoulder 54 and between the bottom side 40 of plate 34 and mounting nut 72. Further, a bronze bushing 76 is interposed between the upper end of hub portion 68 and central opening 56 to accommodate side loading of the screw assembly.

Figure 5:
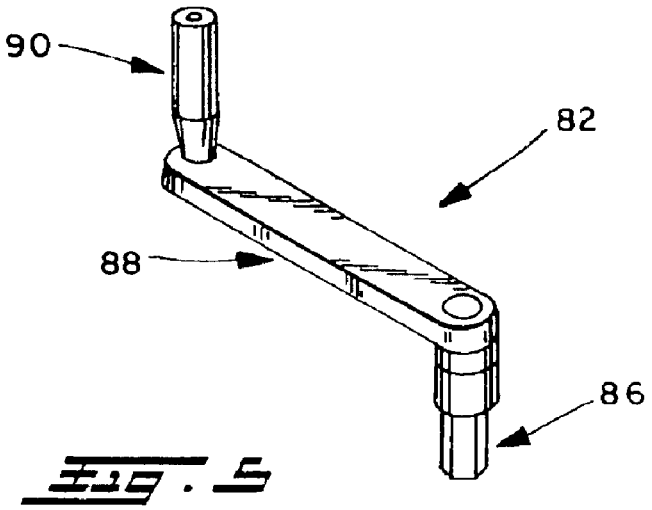

As will be best appreciated from FIGS. 2 and 4, the top surface of flange 70 is exposed at top side 38 of table plate 34, and the outer periphery thereof is provided with graduation marks 78 representing an incremental degree of rotation of the screw assembly. Further, top side 38 of table plate 34 is provided on diametrically opposite sides of the stepped opening therethrough with fixed reference marks 80 relative to which the incremental markings on flange 70 are displaceable. Screw assembly 60 is adapted to be rotated about axis 58 by a suitable tool, such as crank 82 shown in FIG. 5 and, for this purpose, the upper end of cap member 66 is provided with a non-circular recess 84 extending axially thereinto for receiving the non-circular output shaft 86 of crank 82. Preferably, recess 84 and shaft 86 are hexagonal in cross-section, and it will be appreciated that shaft 86 is connected to one end of a crank arm 88 and is adapted to be rotated by a handle or knob member 90 attached to the other end of arm 88.

Lift arm 62 includes a body member 92, preferably of mild steel, which extends transverse to axis 58 and has inner and outer ends 94 and 96, respectively. Inner end 94 is provided with a bore 98 therethrough, and the lift arm further includes a bronze bushing 100 which is press fit in bore 98 and which is internally threaded for threaded interengagement with lift rod 64. Outer end 96 of body member 92 is provided with an opening 102 therethrough which is parallel to axis 58. In the embodiment illustrated, opening 102 is internally threaded for interengagement with a threaded fastener by which the lift arm is attached to the router as set forth hereinafter. Bushing 100 has an axial length greater than the axial thickness of body portion 92 of the lift arm to optimize the area of threaded interengagement between the bushing and lift screw.

With regard to router R herein illustrated and described, the latter is mounted on the underside of plate 34 after lift mechanism 36 is mounted thereon as described above. Then, sub-base 18 is removed from base 14 of the router and base 14 is attached to plate 34 using threaded fasteners 52 which interengage with the threaded openings in base 14 for the fasteners 20 by which sub-base 18 was attached thereto. More particularly in this respect, stop rod mechanism 24 is first removed from base 14 and housing 10 by unthreading rod 26 from the base. When router R has been mounted on the underside of table plate 34 in the foregoing manner, axis A thereof is coaxial with axis 44 of opening 42 in plate 34. To complete the mounting, end 96 of lift arm 62 is attached to abutment 28 on the router housing by means of a bolt 104 having a head 106 engaging the underside of abutment 28 together with a washer 108 and having a threaded shank 110 extending through the abutment and into threaded interengagement with opening 102 of the lift arm. When the router and lift mechanism are so mounted, rotation of lift screw assembly 60 in opposite directions about axis 58 displaces lift arm 62 and thus housing 10 of router R axially toward and away from table plate 34 for adjusting the height of a router bit relative to top side 38 of the table plate. Preferably, lift screw 64 has a ½-32 thread, whereby one revolution of the screw displaces lift arm 62 and thus router housing 10 and a router bit mounted in the router 1/32 inch relative to top side 38 of plate 34. The graduation marks 78 on flange 70 of cap member 66 preferably represent approximately 0.001 inch of axial displacement of the lift arm. Thus, extremely small and precise adjustments of a router bit relative to top side 38 of the table plate are possible.

While considerable emphasis has been placed herein on the structures and structural interrelationships between the component parts of the lift mechanism herein illustrated and described, it will be appreciated that other embodiments can be made and that many changes can be made in the disclosed embodiment without departing from the principles of the invention. In this respect in particular, it will be appreciated that the lift arm could be permanently attached to the router as opposed to being removably fastened thereto. Further, in connection with the latter it will be appreciated that opening 102 through the arm could be an unthreaded bore and the arm connected to the router through the use of a nut and bolt or other fastening arrangement. Still further, it will be appreciated that the opening, whether threaded or unthreaded could extend through the arm transverse to the screw axis rather than parallel thereto. Moreover, while the invention is illustrated and described herein in connection with a Hitachi Model M12V plunge router, the invention is applicable to many other plunge routers including, for example, and without excluding others, routers marketed by Porter Cable, Makita, Freud, and DeWalt. These and other modifications of the embodiment disclosed herein as well as other embodiments of the invention will be obvious or suggested to those skilled in the art from the disclosure herein, whereby the foregoing descriptive matter is to be interpreted merely as illustrative of the present invention and not as a limitation.

Having thus described the invention, it is so claimed:

1. A lift mechanism for a plunge router having a base mounted on the underside of a table having a top side and an opening therethrough having an opening axis, the plunge router being coaxial with said opening axis and axially displaceable relative to the base toward and away from said table, said lift mechanism comprising an adjusting screw rotatable relative to said table and having a screw axis, a lift arm threadedly engaged with said screw and having an end spaced therefrom and interconnected with the router, whereby rotation of said screw in opposite directions about said screw axis displaces said router toward and away from said table.

2. A lift mechanism for a plunge router having a base mounted on the underside of a table having a top side and an opening therethrough having an opening axis, the plunge router being coaxial with said opening axis and axially displaceable relative to the base toward and away from said table, said lift mechanism comprising an adjusting screw rotatable relative to said table and having a screw axis, a lift arm threadedly engaged with said screw and having an end spaced therefrom and interconnected with the router, whereby rotation of said screw in opposite directions about said screw axis displaces said router toward and away from said table, said adjusting screw having an end exposed at said top side of said table, and indicia on said end for indicating the position of the router relative to the table.

3. A lift mechanism according to claim 1, wherein said adjusting screw has an end exposed at said top side of said table, said end including means for rotating said adjusting screw.

4. A lift mechanism according to claim 3, wherein said end includes indicia for indicating the position of the router relative to said table.

5. A lift mechanism according to claim 1, wherein the router has a housing and said end of said lift arm is interconnected with the housing.

6. A lift mechanism for a plunge router having a base mounted on the underside of a table having a top side and an opening therethrough having an opening axis, the plunge router being coaxial with said opening axis and axially displaceable relative to the base toward and away from said table, said lift mechanism comprising an adjusting screw rotatable relative to said table and having a screw axis, a lift arm threadedly engaged with said screw and having an end spaced therefrom and interconnected with the router, whereby rotation of said screw in opposite directions about said screw axis displaces said router toward and away from said table, the router having a housing, said end of said lift arm being interconnected with the housing, the router housing including a member for interengaging with a router stop rod, and said end of said lift arm being interconnected with the housing member.

7. A lift mechanism according to claim 1, and means for rotating said adjusting screw.

8. A lift mechanism according to claim 1, wherein said adjusting screw includes means for interengaging with a tool for rotating the screw.

9. A lift mechanism for a plunge router having a base mounted on the underside of a table having a top side and an opening therethrough having an opening axis, the plunge router being coaxial with said opening axis and axially displaceable relative to the base toward and away from said table, said lift mechanism comprising an adjusting screw rotatable relative to said table and having a screw axis, a lift arm threadedly engaged with said screw and having an end spaced therefrom and interconnected with the router, whereby rotation of said screw in opposite directions about said screw axis displaces said router toward and away from said table, said adjusting screw including a threaded rod having opposite ends, one of said ends being an upper end, a cap member on said upper end having a hub receiving said rod and a circumferential flange extending radially outwardly of said hub, the table having a stepped opening therethrough from said top side for receiving said adjusting screw and including a radial shoulder for engagement by said flange and a central opening for receiving said hub, and said adjusting screw further including a mounting nut on said rod engaging the under side of the table for rotatably mounting said rod and cap member on the table.

10. A lift mechanism according to claim 9, wherein said adjusting screw further includes bushing elements between said flange and said shoulder and between said mounting nut and the underside of said table.

11. The lift mechanism according to claim 10, further including a bushing between said hub and said central opening.

12. A lift mechanism according to claim 9, wherein said circumferential flange has an upper surface exposed at said top side of said table, and indicia on said upper surface for indicating the position of the router relative to the table.

13. A lift mechanism according to claim 12, wherein said cap member includes a tool receiving recess for a tool for rotating the adjusting screw.

14. A lift mechanism according to claim 9, wherein the router has a housing and said end of said lift arm is interconnected with the housing.

15. A lift mechanism according to claim 14, wherein the router housing includes a member for interengaging with a router stop rod and said end of said lift arm is interconnected with the housing member.

16. A lift mechanism according to claim 9, wherein said lift arm includes a body member extending transverse to said screw axis and having an axial thickness with respect thereto, and an internally threaded bushing mounted on said body member for threaded engagement with said threaded rod and having an axial length greater than said axial thickness.

17. A lift mechanism, according to claim 16, wherein said end of said lift arm includes an opening therethrough for a fastener by which said lift arm is interconnected with the router.

18. A lift mechanism according to claim 16, wherein said adjusting screw further includes bushing elements between said flange and said shoulder and between said mounting nut and the underside of said table.

19. A lift mechanism according to claim 18, further including a bushing between said hub and said central opening.

20. A lift mechanism according to claim 19, wherein said circumferential flange has an upper surface exposed at said top side of said table, and indicia on said upper surface for indicating the position of the router relative to the table.

21. A lift mechanism according to claim 20, wherein the router has a housing and said end of said lift arm is interconnected with the housing.

22. A lift mechanism according to claim 21, wherein the router housing includes a member for interengaging with a router stop rod and said end of said lift arm is interconnected with the housing member.

23. A lift mechanism according to claim 1, wherein said lift arm includes a body member extending transverse to said screw axis and having an axial thickness with respect thereto, and an internally threaded bushing mounted on said body member for threaded engagement with said threaded rod and having an axial length greater than said axial thickness.

24. A lift mechanism according to claim 23, wherein the router has a housing and said end of said lift arm is interconnected with the housing.

25. A lift mechanism according to claim 24, wherein the router housing includes a member for interengaging with a router stop rod and said end of said lift arm is interconnected with the housing member.

26. A lift mechanism according to claim 25, wherein the end of said lift arm includes an opening therethrough for a fastener by which said lift arm is interconnected with said housing member.

* * * * *